United States Patent [19]

Persson

[11] 4,285,165

[45] Aug. 25, 1981

[54] ARRANGEMENT IN A GATE

[76] Inventor: Torsten H. Persson, Froarpsvägen 36, S-290 72 Asarum, Sweden

[21] Appl. No.: 80,118

[22] Filed: Jun. 21, 1979

[51] Int. Cl.[3] ..... E05F 15/20; E05F 1/04

[52] U.S. Cl. ..... 49/30; 49/238

[58] Field of Search ..... 49/236, 237, 238, 30

[56] References Cited

U.S. PATENT DOCUMENTS

| | | | |
|---|---|---|---|
| 1,084,733 | 1/1914 | Donnell | 49/238 |
| 1,218,715 | 3/1917 | Sundh | 49/238 |
| 1,409,369 | 3/1922 | Fare . | |
| 1,609,369 | 12/1926 | Laird | 49/237 |
| 1,684,578 | 9/1928 | Edwaris | 49/237 |
| 2,068,254 | 1/1937 | Wilson | 49/238 X |
| 2,086,061 | 7/1937 | Barr | 49/237 |
| 2,693,653 | 11/1954 | Dean, Jr. | 49/238 |

FOREIGN PATENT DOCUMENTS

| | | |
|---|---|---|
| 184950 | 5/1907 | Fed. Rep. of Germany . |
| 1492486 | 8/1967 | France . |
| 481285 | 3/1938 | United Kingdom . |

*Primary Examiner*—Philip C. Kannan

*Attorney, Agent, or Firm*—Berman, Aisenberg & Platt

[57] ABSTRACT

An arrangement in a gate (10) wherein a cam track (23) is provided for lifting the gate on the pivot axis (12) thereof when the gate is being swung to opened position. An abutment (34) is provided in the cam track for a member (18) connected with the gate. The abutment is arranged to maintain the position in the cam track when the gate is being swung to opened position and is arranged for delayed yielding under the pressure exerted against the abutment by the gate (10) over the member when the gate is in opened position and is lifted by the cam track.

5 Claims, 3 Drawing Figures

ARRANGEMENT IN A GATE

The present invention relates to a gate which is displaceable vertically on the pivot axis thereof and rests by a support roller on a stationary cam track having a lowermost point which determines a rest position of the gate, corresponding to the closed position thereof, and climbs on at least one side of said point in order that the gate when being swung towards at least one side from the closed position shall be returned by gravity to closed position by the support roller rolling down the cam track.

U.S. Pat. No. 1,609,369 of Dec. 7, 1926 describes a gate of the type referred to above, which can be swung to opened position by being pushed out of the way by a vehicle which presses against the gate, and then automatically swings back to the closed position thereof when the vehicle has passed through the gate opening.

A drawback of this prior art gate is that it returns too rapidly to the closed position thereof so that there is a risk that the vehicle passing through the gate opening rubs the side against the gate whereby the gate can get caught on the vehicle or can cause damage thereon.

For the purpose of eliminating this drawback and providing a gate with delayed return in order that the gate shall remain in the opened position during the time necessary for the vehicle to pass through the gate opening, it is proposed to arrange a gate of the type referred to above in accordance with the characteristics appearing from claim 1.

Figure 1:
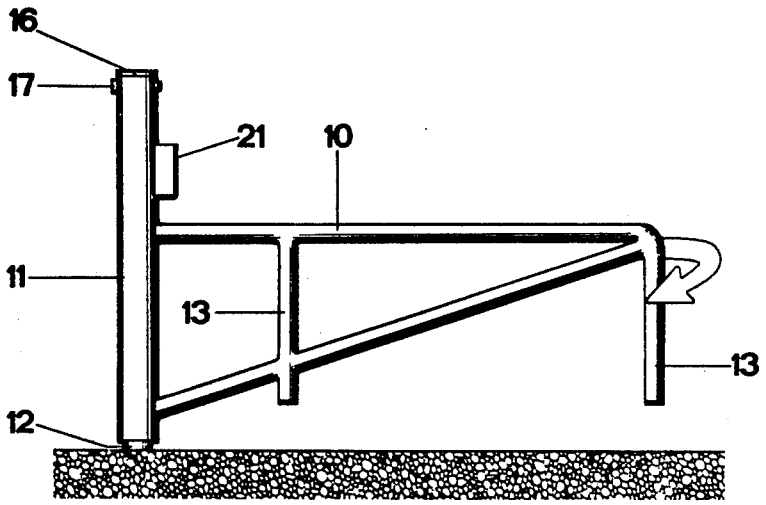
Figure 2:
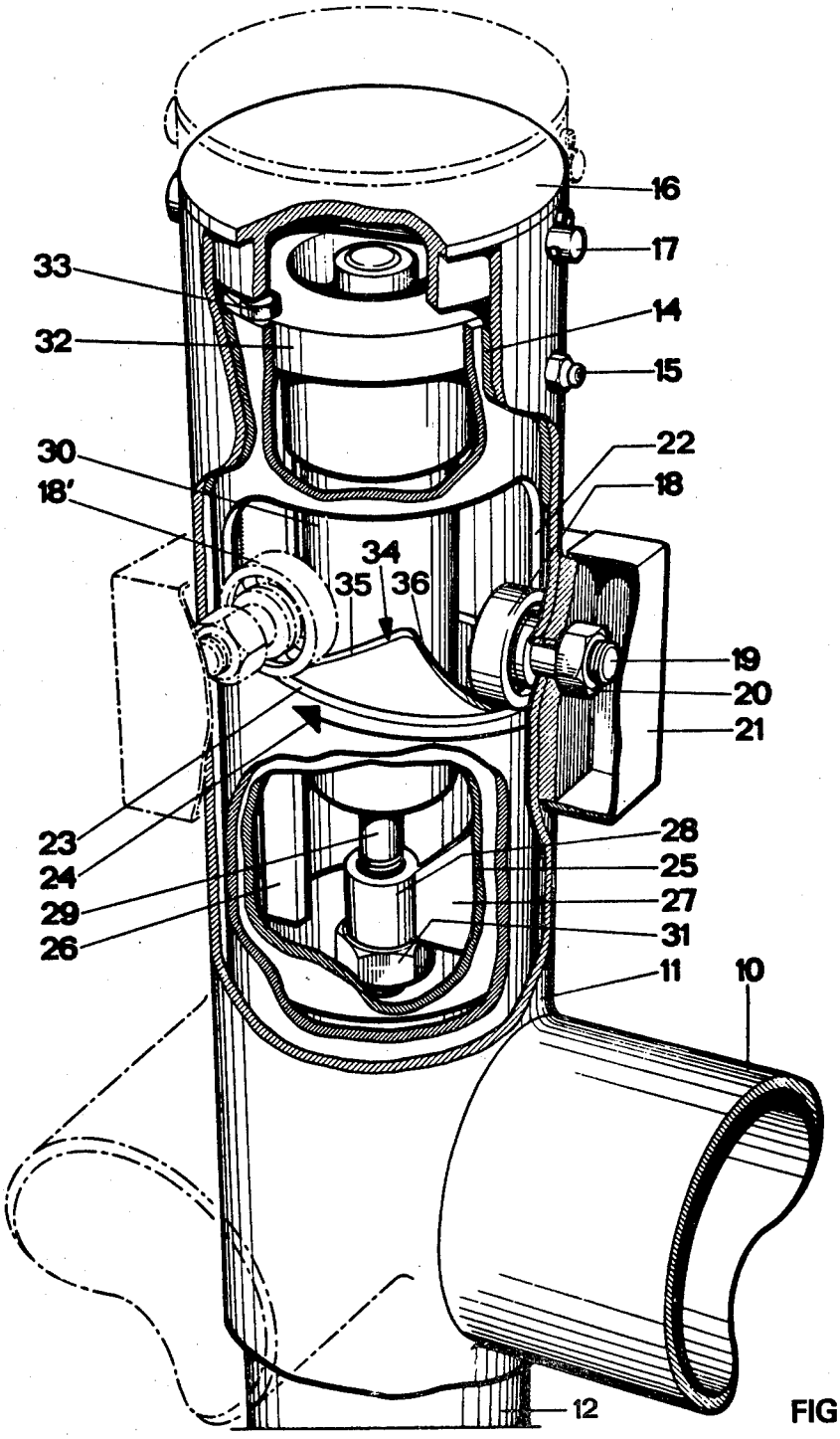

In order to illustrate the invention this will be described in more detail below with reference to the accompanying drawing in which FIG. 1 is a side view of a gate arranged according to the invention, and FIG. 2 is an enlarged perspective view of the arrangement according to the invention.

Figure 3:
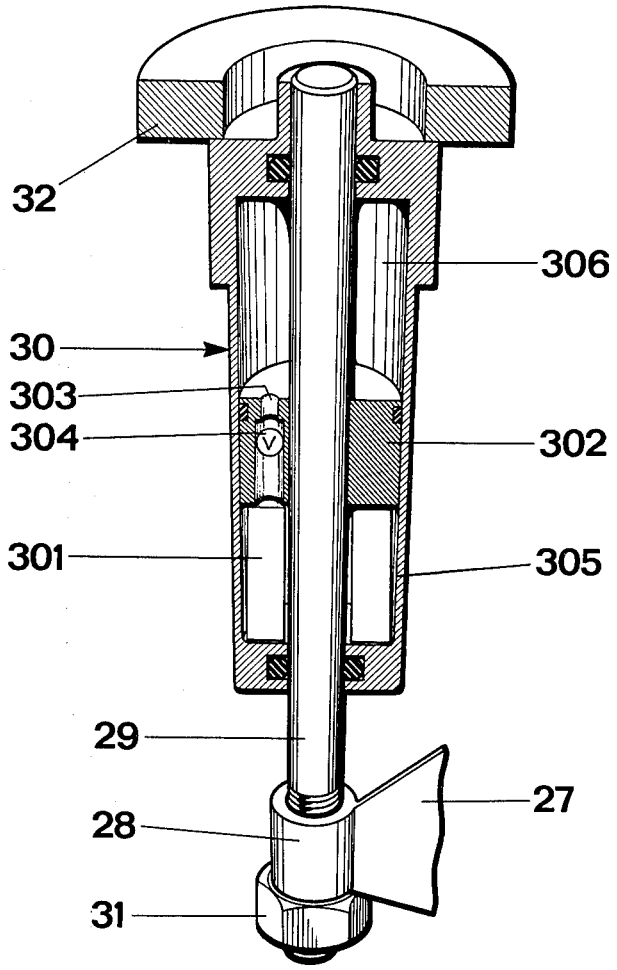

FIG. 3 is an enlarged perspective view of a suitable damper means and related assembly.

The gate of FIG. 1 comprises a tube construction 10 which is journalled by means of a vertical tube 11 on a gate pole 12. The gate has vertical tubes 13 suitably spaced in order that a vehicle which moves towards the gate shall hit the gate with the bumper thereof at these tubes and push the gate out of the way from the closed position thereof when the vehicle is moving through the gate opening.

As will be seen from FIG. 2, the gate tube 11 is journalled on the tubular gate pole 12 by means of bushings 14 which can be provided at top and bottom in the tube 11 and possibly at one or more positions therebetween. The gate tube 11 is not only pivoting but also displaceable vertically on the gate pole 12, and one or more grease fittings 15 are provided for lubricating the bearings between the gate tube and the gate pole so that the gate tube runs easily on the gate pole. At the top, the gate tube 11 is closed by a cover 16 which can be secured by means of a lock bolt 17 or the like.

On the inner side of the gate tube 11 there is pivotally mounted a support roller 18 formed as a ball bearing roller with a trunnion 19 secured by a screw connection 20 to the gate tube. The screw connection is covered externally by a metal sheet casing 21. The support roller 18 is received by an opening 22 in the gate pole 12, and the lower edge of this opening forms a cam track 23 climbing progressively in the direction of the arrow 24 from the position of the support roller 18, shown to the right in FIG. 2. Said position of the support roller 18 corresponds to the closed position of the gate 10.

Inside the gate pole a tubular element 25 is mounted for axial displacement, and this element is non-rotatably guided by means of an axially extending rib 26 fixedly arranged inside the gate pole 12. By means of a bracket 27 having a socket 28 at the outer end thereof, the element 25 is secured to the piston rod 29 of a hydraulic ram 30 by means of a screw connection 31, and the ram 30 is connected at the upper end thereof to a ring or plate 32 which in turn is secured to the gate pole 12 by means of a screw connection 33. As shown in FIG. 3, the hydraulic ram 30 is of the type (shock absorber) having a spring 301 which biases the piston 302 of the hydraulic ram in one direction which is assumed to correspond in the present case to displacement of the piston rod 29 in upward direction. Furthermore, the piston 302 of the hydraulic ram 30 has a connection 303, controlled by a valve 304 between the cylinder 305 and 306 filled with hydraulic fluid on each side of the piston 302, said connection being of the kind allowing fluid to pass between the opposite sides of the piston when the piston is displaced upwardly under the bias of the spring, by the valve 304 being lifted from the seat thereof under the pressure of the hydraulic fluid against spring bias, while the flow of the fluid is choked when the piston is displaced downwardly in the cylinder against the bias of the spring 301, the fluid passing through a narrow passage in the valve 304.

The element 25 forms a crest 34 having a gently sloping ram 35 and a steeper ramp 36, and under the bias of the spring in the hydraulic ram 30 this crest is located in the path of the support roller 18 along the cam track 23 as is shown in FIG. 2, the crest 34 projecting upwardly from the cam track 23 as a nose. The crest is kept in this position by the spring and it can be depressed from said position by a slow motion only against the bias of the spring because the choked flow of hydraulic fluid between the opposite sides of the piston retards such depression. The piston has a stroke which is large enough for the crest to be depressed sufficiently to a position wherein it is flush with the cam track 23, or at least to a position wherein the crest projects slightly from this cam track. However, when the pressure against the crest 34 is relieved, the crest will rapidly return to the position shown under the bias of the spring in the hydraulic ram 30 because the fluid can then pass rapidly from one side of the piston to the other side thereof.

If the gate is swung towards opened position according to the arrow in FIG. 1 by a vehicle being driven against the gate and pushing this out of the way, this means that the support roller 18 rolls in the direction of the arrow 24, the roller being lifted from the cam track 23 when it is rolling upwards the ramp 36 on the crest 34 in order to roll thereafter onto the cam track 23 again along the ramp 35. During this movement the gate is thus lifted, the gate tube 11 being displaced vertically on the gate pole 12, and since the oil in the hydraulic ram 30 by the choking action in the valve controlled opening in the piston retards the movement downwards of the crest 34, this crest will not be depressed when the support roller 18 is moving over same. Some small depression may of course occur at the passage of the roller but it is of no significance. The support roller 18 will be caught by the crest 34 at the side of the crest where the ramp 35 is provided, and will now be in the position 18' as indicated by dash and dot lines, in which the gate is fully opened and thus is swung substantially 90° or preferably more than 90° from the position shown in FIG. 1. Having passed the top of the crest 34 the support roller 18 will roll down the ramp 35 under the weight of the gate so that the gate as a consequence thereof will be swung automatically to opened position without the vehicle pushing against the gate. This automatic swinging can begin in a 45° to 60° position of the gate. Resting against the cam track 23 and against the ramp 35 the support roller 18 will cause a pressure against the crest 34 in the position 18' , said pressure being dependent on the weight of the gate, and the crest will then move slowly downwards against the bias of the spring provided in the ram 30, as allowed by the flow of hydraulic fluid between the two sides of the piston through the choked opening therein. Eventually, the crest 34 will reach a position in which the support roller 18 can roll along the cam track 23 back to the position shown by solid lines in FIG. 2. By adapting the choking in the piston and the inclination angles of the cam track 23 and the ramp 36 in a suitable way in relation to the weight of the gate, it is possible to adapt, as desired, the time it takes for the gate to depress the crest 34 when the gate is in the opened position in order that the gate shall then be able to swing to the closed position thereof. As soon as the support roller 18 has passed the depressed crest 34, when the gate is moving from opened position to closed position, the spring of the hydraulic ram 30 will rapidly press the crest 34 upwards to the position shown because such movement is not prevented to a significant extent by the fluid in the hydraulic ram. Then the gate is ready to be opened again in the manner described.

Thus, it will be seen by the arrangement according to the invention the gate will be swung automatically to the opened position when such movement has been initiated by a vehicle moving against the gate and pushing it out of the way, and the gate will also be securely retained in the opened position thereof in order that the gate shall return after a delay to the closed position thereof. Moreover, it is possible to adapt the delay in such a manner that the gate will be maintained in the opened position long enough for a vehicle of maximum length to pass through the gate opening at a low speed.

As described above, the arrangement allows the gate to be swung towards one side only, but of course it is possible to provide the element 25 with two diametrically opposite crests 34 and to make the opening 22 in the gate pole sufficiently large so that the gate can be swung towards one side or the other from a rest position in which the gate is closed and will be retained for delayed return independently of the gate being swung towards one side or the other. The same element 25 and the same hydraulic ram 30 can control the delay towards both sides.

The invention is not, of course, limited to the embodiment shown but can be designed in other ways within the scope of the accompanying claims. This is true e.g. for the arrangement of the hydraulic ram 30 which is shown in a suspended position but can be arranged also in a standing position inside the gate pole 12. It is also possible to let the ram 30 move together with the element 25 while the piston rod 29 is fixedly secured to the gate pole 12. Moreover, the element 25 can be arranged in different ways but the tubular embodiment shown herein would be preferred considering that the element thereby can be guided in a relatively simple manner. The spring can be arranged outside the cylinder instead of being located inside the cylinder as has been said to be the case in the embodiment shown.

I claim:

1. A combination of (a) a swingable gate which has a normally closed or rest position and an open position and (b) a supporting post on which the gate is operably mounted for both pivoting and vertical displacement which is characterized by:

a roller attached to the gate and supported by a stationary cam track on the post; the cam track having a slope from a lowermost point, which determines and thus coincides with a rest position of the gate corresponding to the closed position, to continuously higher points on at least one side of the lowermost point and along a path which the roller follows when the gate is moved from the open position to the closed or rest position; the slope being of sufficient magnitude so that the roller rolls down the cam track by gravity to return the gate from the open position to the closed position;

an abutment which is movable from a normal position in the path which the roller follows along the cam track to another position in which it is sufficiently removed from said path to allow the roller to return by gravity to the rest position, the normal position permitting movement of the roller in a direction away from the rest position to the open position of the gate but preventing the roller from returning under gravity from the open position of the gate to the rest position and;

damper means actuated by pressure of the roller on the abutment to move the abutment against a spring bias from the normal position to the other position, the spring bias being sufficient to return the abutment rapidly to the normal position after the roller passes thereover to the rest position.

2. A combination according to claim 1 wherein the abutment is in the form of a crest having a steep ramp facing the rest position and a gently-sloping ramp facing away from the rest position.

3. A combination according to claim 1 wherein the damper means comprises a hydraulic ram having a piston in a hydraulic-fluid-containing cylinder which provides space on opposite sides of the piston and a check-valve-controlled passage between the two sides of the piston to allow rapid flow of hydraulic fluid between the cylinder spaces on opposite sides of the piston in one direction corresponding to the return of the abutment under the spring bias and slow flow of hydraulic fluid in the other direction corresponding to depression of the abutment under pressure of the roller.

4. A combination according to claim 1 wherein the cam track is an edge of a recess in a tubular gate pole which is part of the supporting post.

5. A combination according to claim 4 wherein the abutment is part of a tubular element guided for axial displacement in the tubular gate pole.

* * * * *